US008167342B2

(12) United States Patent
Bertolotti

(10) Patent No.: US 8,167,342 B2
(45) Date of Patent: May 1, 2012

(54) OUTER DOOR HANDLE FOR AUTOMOTIVE VEHICLES

(75) Inventor: Angelo Bertolotti, Turin (IT)

(73) Assignee: ITW Automotive Products GmbH & Co. KG, Iserlohn (DE)

( * ) Notice: Subject to any disclaimer, the term of this patent is extended or adjusted under 35 U.S.C. 154(b) by 795 days.

(21) Appl. No.: 12/293,114

(22) PCT Filed: Mar. 30, 2007

(86) PCT No.: PCT/IB2007/000844
§ 371 (c)(1),
(2), (4) Date: Sep. 16, 2008

(87) PCT Pub. No.: WO2007/148167
PCT Pub. Date: Dec. 27, 2007

(65) Prior Publication Data

US 2009/0085360 A1 Apr. 2, 2009

(30) Foreign Application Priority Data

Jun. 17, 2006 (DE) ..... 10 2006 027 912

(51) Int. Cl.
*E05B 3/00* (2006.01)
*E05B 65/10* (2006.01)

(52) U.S. Cl. ..... 292/336.3; 292/DIG. 22; 292/DIG. 65

(58) Field of Classification Search ..... 292/336.3, 292/DIG. 22, DIG. 65
See application file for complete search history.

(56) References Cited

U.S. PATENT DOCUMENTS

| | | | | |
|---|---|---|---|---|
| 5,669,642 | A | 9/1997 | Kang | |
| 6,042,159 | A * | 3/2000 | Spitzley et al. | 292/216 |
| 6,070,923 | A | 6/2000 | Tanimoto et al. | |
| 6,648,382 | B1 * | 11/2003 | Monig et al. | 292/336.3 |
| 7,029,042 | B2 * | 4/2006 | Belchine, III | 292/336.3 |
| 7,210,716 | B2 * | 5/2007 | Mueller et al. | 292/336.3 |
| 7,422,251 | B2 * | 9/2008 | Tanimoto et al. | 292/347 |
| 7,779,659 | B2 * | 8/2010 | Tanimoto et al. | 70/210 |

OTHER PUBLICATIONS

ISR for PCT/IB2007/000844 mailed Feb. 19, 2008.

* cited by examiner

*Primary Examiner* — Carlos Lugo
(74) *Attorney, Agent, or Firm* — Lowe Hauptman Ham & Berner LLP

(57) ABSTRACT

An automobile outer door handle, comprising a lever-shaped handle portion which is manually gripped from the door's outer side and which is fitted with at least one bearing element resting in pivotably manner on a mating bearing element of the door and is coupled by a linkage to a door lock in a manner that, when this lock shall open when the handle portion is pivoted out of a rest position into an open position, an inertial mass being supported in excursion-limited manner in the region of the swivel bearing of the handle portion in a similar direction as the handle portion, said inertial mass locking in one limit position (blocked position) the handle portion into the rest position whereas releasing it in the other limit position (release position) and being moved into the blocked position when a predetermined transverse acceleration acts on the automobile to exert an opening force on the handle portion.

7 Claims, 1 Drawing Sheet

OUTER DOOR HANDLE FOR AUTOMOTIVE VEHICLES

The present invention relates to an automobile outside door handle.

Most automobile outside door handles are mounted in an automobile body recess, which will be entered by the fingers of a hand to pivot outward a lever-like door handle portion. The handle portion is appropriately pivotably supported rests in the door. The handle portion is connected by a linkage to a door lock which shall be opened when this handle portion is pivoted outward, whereby the door may be moved into its open position.

There are numerous accidents where the automobile is impacted sideways. In such an impact, the automobile is accelerated transversely, the said handle portion by inertia tending to remain in position while the vehicle abruptly changes its position. In this manner an opening force is applied to the handle portion and hence on the door lock, raising the danger the door shall burst open.

The objective of the present invention is to create an automobile outer door handle precluding door opening even when high accelerations are applied to said automobile.

In the outer handle of the present invention, a inertial mass is supported in displaceable manner within given limits in the region of the handle portion's swivel bearing and approximately in the same direction as the handle portion. The inertial mass is displaceable between two limit positions, namely a blocking position wherein the handle portion is locked in its rest position and a release position wherein said handle portion is allowed to pivot. The inertial mass is mechanically biased (prestressed) toward the release position. The inertial mass moves into its blocked position when a predetermined transverse acceleration is applied to the automobile and exerts an opening force on the handle portion.

The inertial mass used in the invention may be relatively small, being merely required to permit moving it during a transverse acceleration against its mechanical bias into its blocked position wherein it then locks the handle portion or a bearing element thereof in position. Accordingly the means to implement locking the outer door handle in this manner are very simple. Again the automobile weight is only minimally raised by such an inertial mass even when four-door vehicles are equipped with one inertial mass at each door handle.

The mechanical bias of the inertial mass into the release position can be implemented by gravity. In one embodiment mode of the present invention, the inertial mass is spring-biased.

Conceptually the inertial mass may be displaced rectilinearly. Preferably however the inertial mass shall be displaced pivotably between the release and blocked positions. In a special embodiment mode of the latter feature, the inertial mass rests pivotably about a pivot pin at the bearing element, said axis being parallel approximately to that axis about which the bearing element is supported about the mating bearing element. The inertial mass comprises a blocking element spaced from its pivot pin, said blocking element cooperating—when the inertial mass is in its blocked position—with a blocking surface of the mating bearing element. Illustratively said blocking surface may be in the form of a recess in the mating bearing element. Accordingly, in the present invention, said inertial mass assumes the form of a single-arm lever or a pendulum, the center of gravity of such a component being a distance from its pivot axis.

In a further embodiment mode of the present invention, the inertial mass is fitted with a rest element situated on the side of the pivot pin opposite the blocking element, said rest element being biased by said biasing spring against stop surface of mating bearing element in a manner that, upon the handle portion being pivoted into the open position, the inertial mass shall be pivoted toward the release position. The last described design ensures that the handle portion may be freely pivoted under ordinary circumstances without said inertial mass becoming a blocking means.

Various designs are conceivable to reduce the present invention to practice. One approach calls for the handle portion comprising two horizontally spaced mating support arms. One of these support elements comprises two parallel apart support arms receiving between them one mating support arm, the inertial mass resting in pivotable manner on the end zone of a support arm.

The invention is elucidated below by an illustrative embodiment shown in the appended drawings.

Figure 1:
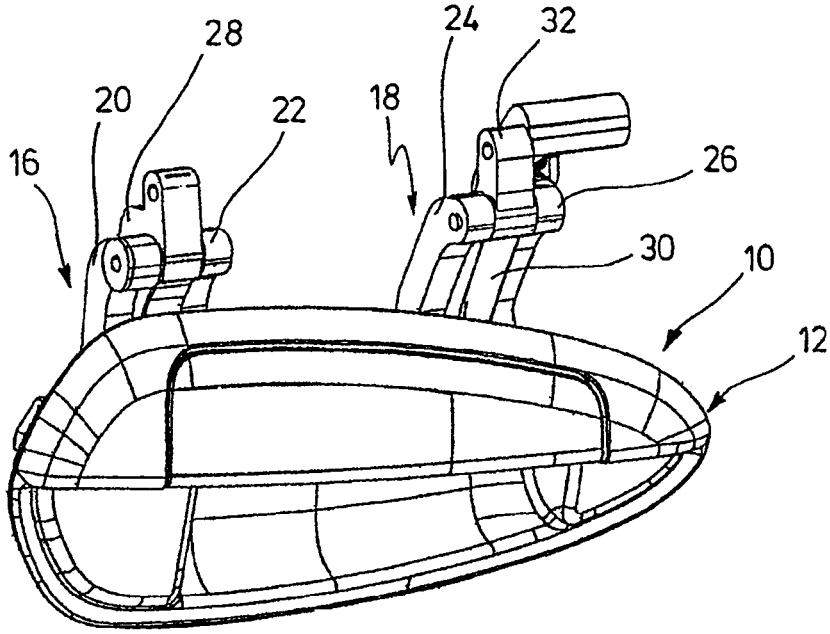
FIG. 1 is a perspective of an outer door handle of the invention.
Figure 2:
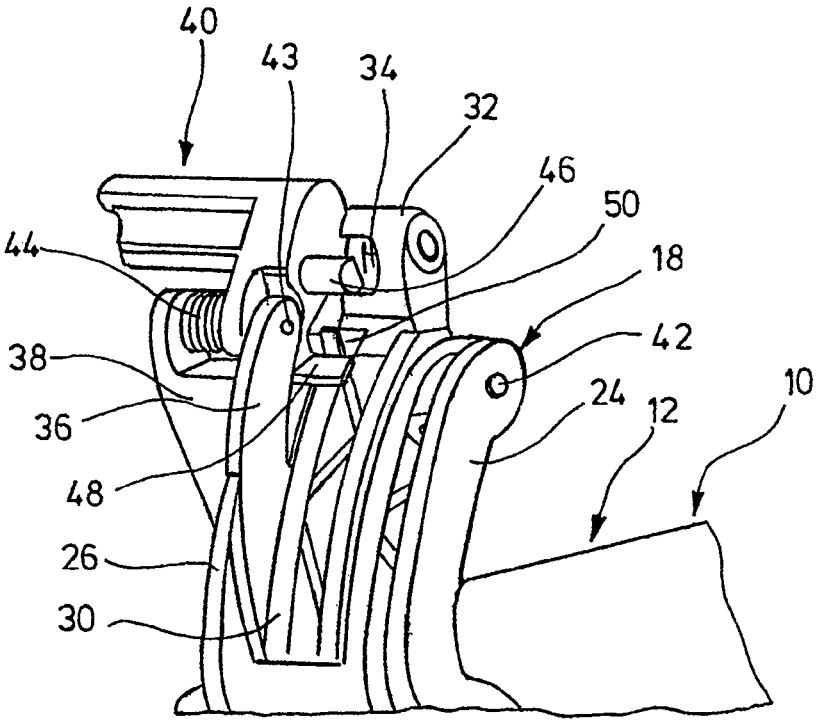
FIG. 2 is a perspective of an applicable locking means for the outer door handle of FIG. 1 as seen from the side opposite to that of FIG. 1.

FIGS. 1 and 2 show an outer door handle denoted overall by 10. For simplicity, the associated door of the automobile is omitted. The outer door handle comprises a handle portion 12 accessible externally from the door and allowing gripping it in order to pivot it from a rest position shown in FIG. 1 into an open position, the pivoting motion relating to FIG. 1 being toward the viewer of FIG. 1

Seen from the rear side of the handle portion 12, there are two support arms 16, 18 which comprise two arm elements 20, 22 and 24, 26 respectively, configured in fork-like manner. Mating support arms 28, 30 are mounted between the arm elements 20, 22 and 24, 26 respectively. As a result and using an omitted spindle, the support arms 16, 18 rest on the mating support arms 28, 30 in pivotable manner about a common pin which optionally may run approximately horizontally. In a manner not shown in detail here, the mating support arms 28, are rigidly affixed to the automobile door.

As shown by FIG. 2, the mating support arm comprises an upward extension 32 fitted with a locking recess 34. A further support arm 36 is integral with the support arm 26 and, jointly with a support element 38, constitutes a bearing for the inertial mass 40. Overall said inertial mass is L-shaped, one leg of this L resting on a pivot pin parallel to the support pin of the support arms 24, 26 at the mating support arm 30. Said pivot pin is indicated at 43. A helical spring 44 is mounted on said pivot pin and biases the inertial mass 40 in the counterclockwise direction (as seen in FIG. 2). The operative mass is housed in the other leg of the L-shaped inertial mass 40. An axially parallel blocking element 46 in the form of a cross-sectionally semi-circular protrusion is integrated into the bearing leg of the inertial mass 40 and is situated at the level of the recess 34. A rest element 48 is constituted in the end zone of the bearing leg on the side of the bearing pin 43 of the inertial mass that is opposite the protrusion 46, said rest element 48 coming to rest against the facing side of the mating support arm 30 when the biasing spring 44 is able to prestress the inertial mass 40 in counterclockwise manner. A triangular protrusion 50 is constituted at the mating support arm 30 behind the rest element 48 of FIG. 2, and projects by a given height the rest element 48.

The design described above operates as follows. The handle portion 12 is pivoted clockwise about the bearing pin 42 when the handle would be released. As a consequence the rest element 48 would lift off the mating rest arm 30 if the spring 44 would not rotate the inertial mass counter-clockwise to an extent that the rest element 48 would be adjusted toward said mating rest arm 30, whereby the protrusion 50 by its facing surface also engages the rest element 48. In this manner the opening displacement of the handle portion 12 precludes the blocking element 46 engaging the recess 34. If that had been the case, the handle portion 12 could not have been rotated farther.

Now if following transverse acceleration an opening force does act on the handle portion 12, it would be pivoted into the open position. However the inertial mass 40 in the present case shall be pivoted clockwise against the force of the spring 44, the blocking element 46 moves into the blocking recess 34 whereby the handle portion 12 is locked into its rest position and cannot reach the open position. As soon as the transverse acceleration has dropped below a predetermined value, the inertial mass 40 is returned into its release position.

As already mentioned above, the configuration of the outer door handle in this outer door is not shown in further detail. Moreover the linkage connecting to the door lock also was omitted. Such components are widely known and therefore need not be discussed further.

The invention claimed is:

1. An automobile outer door handle adapted to be mounted to a door of automobile, said outer door handle comprising:

a handle portion configured to be gripped from an outside of the door and pivotable from a rest position to an open position;

at least one supporting arm;

a mating supporting arm which is configured to be fixed to the door and on which the supporting arm pivotably rests;

an inertial mass supported by the supporting arm and pivotably displaceable in the same direction as the handle portion; and a rest element facing the mating supporting arm and on a side of the inertial mass, wherein said inertial mass, in a blocking position, is configured to lock the handle portion into the rest position, said inertial mass, in a release position, is configured to release said handle portion, and is mechanically biased by a biasing member to be displaced into the blocking position when a predetermined transverse acceleration acts on the automobile, said resting element rests against the mating supporting arm when the inertial mass is biased in such a manner that, when the handle portion is pivoted into the open position, the inertial mass is pivoted toward the release position, the inertial mass rests on the supporting arm in a pivotable manner about a pivot pin which is approximately parallel to a support pin about which the supporting arm is supported on the mating supporting arm, and the inertial mass comprises a blocking element spaced from the pivot pin and cooperating, in the blocking position of the inertial mass, with a blocking surface of the mating supporting arm.

2. The outer door handle as claimed in claim 1, further comprising a spring biasing the inertial mass toward and into the release position.

3. The outer door handle as claimed in claim 1, wherein the blocking surface is constituted by a recess of the mating supporting arm.

4. The outer door handle as claimed in claim 2, wherein said at least one supporting arm includes a first supporting arm and a second supporting arm which is spaced away from the first supporting arm, the mating supporting arm is arranged between the first and second supporting arms, and the inertial mass is pivotably supported at an end of the first or second supporting arm.

5. An automobile outer door handle adapted to be mounted to a door of an automobile, said outer door handle comprising:

a handle portion which is configured to be gripped from an outside of the door and pivotable from a rest position to an open position;

at least one supporting arm couplable by a linkage to a door lock to open said lock when said handle portion is pivoted outward into the open position, a mating supporting arm which is configured to be fixed to the door and on which the supporting arm is pivotably rests;

an inertial mass supported by the supporting arm so as to be approximately pivotably displaceable within a limited excursion in the same direction as the handle portion, and a spring, wherein said inertial mass, in a blocking position, is configured to lock the handle portion into the rest position, and said inertial mass, in a release position, is configured to release said handle portion, and is mechanically biased by the spring to be displaced into the blocking position when a predetermined transverse acceleration acts on the automobile and applies an opening force on the handle portion, the inertial mass rests on the supporting arm in a pivotable manner about a pivot pin which is approximately parallel to a support pin about which the supporting arm is supported on the mating supporting arm, the inertial mass includes a blocking element spaced from the pivot pin and cooperating, in the blocking position of the inertial mass, with a blocking surface of the mating supporting arm, on a side of the pivot pin that is opposite the blocking element, the outer door handle further includes a rest element, and when the inertial mass is biased by the spring, said rest element rests against a stop surface of the mating supporting arm in such a manner that, when the handle portion is pivoted into the open position, the inertial mass is pivoted toward the release position.

6. The outer door handle as claimed in claim 5, wherein the blocking surface is constituted by a recess of the mating supporting arm.

7. The outer door handle as claimed in claim 5, wherein said at least one supporting arm includes a first supporting arm and a second supporting arm which is spaced away from the first supporting arm, the mating supporting arm is arranged between the first and second supporting arms, and the inertial mass is pivotably supported at an end of the first or second supporting arm.

* * * * *